United States Patent [19]

Eriksson et al.

[11] 4,431,225

[45] Feb. 14, 1984

[54] RELEASING DEVICE IN CORE BARREL GRAPPLERS

[75] Inventors: Sune W. Eriksson, Spånga; Gunnar K. Egnelöv, Johanneshov, both of Sweden

[73] Assignee: Craelius AB, Bromma, Sweden

[21] Appl. No.: 308,529

[22] Filed: Oct. 5, 1981

[30] Foreign Application Priority Data

Oct. 8, 1980 [SE] Sweden ..... 8007045

[51] Int. Cl.[3] ..... E21B 31/12

[52] U.S. Cl. ..... 294/86.19; 166/125; 294/86.22

[58] Field of Search ..... 294/86.1, 86.14, 86.17, 294/86.19–86.33; 166/123, 125, 181; 175/246–248

[56] References Cited

U.S. PATENT DOCUMENTS

| | | | |
|---|---|---|---|
| 2,948,340 | 8/1960 | Bostock et al. | 166/125 X |
| 2,980,185 | 4/1961 | Daffin | 166/123 X |
| 3,537,743 | 11/1970 | Martinsen | 294/86.17 |
| 3,701,389 | 10/1972 | Egnelov | 175/246 |

*Primary Examiner*—Johnny D. Cherry

*Attorney, Agent, or Firm*—Barnes & Thornburg

[57] ABSTRACT

A device for disengaging a grappling device from a core barrel, which are lowered in an engaged or connected state into a hollow drill rod, is actuated by a recess made in the drill rod bore, when the barrel approaches or assumes a working position in the drill rod, and is thereby displaced by a spring for disengaging the mechanism connecting the grappling device and barrel.

8 Claims, 4 Drawing Figures

RELEASING DEVICE IN CORE BARREL GRAPPLERS

DESCRIPTION

1. Technical Field

The present invention relates to a device for releasing a grappling means from a core barrel, the device and means being at the bottom of a hollow drill rod in a coupled condition.

2. Background Art

In wire line drilling it is known to lower a core barrel coupled to a grappling means provided with a wire or cable into a drill rod string formed by a plurality of hollow rods. This method is preferably used in drilling dry holes.

Before drilling commences the grappling means must be disengaged from the core barrel at the bottom of the string in its working position and pulled up out of the string.

Prior art devices for disengaging the grappling means from the core barrel are burdened with several disadvantages. Most of them are released, when the core barrel is in its working position and axially latched by latching dogs, by pulling heavily on the wire. The drawback here is that the core barrel catches on some projection in the string while the wire is still being fed into the string, and when the core barrel is released from its temporary obstruction in the string to fall freely once again, the retardation force occurring when the wire is once again tensioned releases the latching mechanism and the grappling means is disengaged from the core barrel, which then falls down to the working level, resulting in bit destruction in many cases.

A device is also known which disengages the grappling means from the core barrel with the aid of a sleeve which is movable in relation to the grappling means and mounted thereon (see U.S. Pat. No. 3,701,389). The primary drawback with this device is that it can release the means coupling the grappling means and core barrel before the barrel has arrived at its working position in the bottom drill rod if the barrel comes against something projecting into the drill rod bore during lowering of the barrel.

DISCLOSURE OF INVENTION

The object of the present invention is to provide a device of the kind mentioned in the introduction, by means of which the drawbacks of previously known devices have been circumvented.

This object is fulfilled by the device in accordance with the invention being given the characterizing features set forth in the claims.

The foremost advantages of the invented device is that it can release the means connecting the grappling means and core barrel only when the barrel is at a predetermined distance from, or assumes a working position in the bottom drill rod, and that it is actuated by a recess in the wall of the bottom drill rod.

PREFERRED EMBODIMENT

Figure 1:
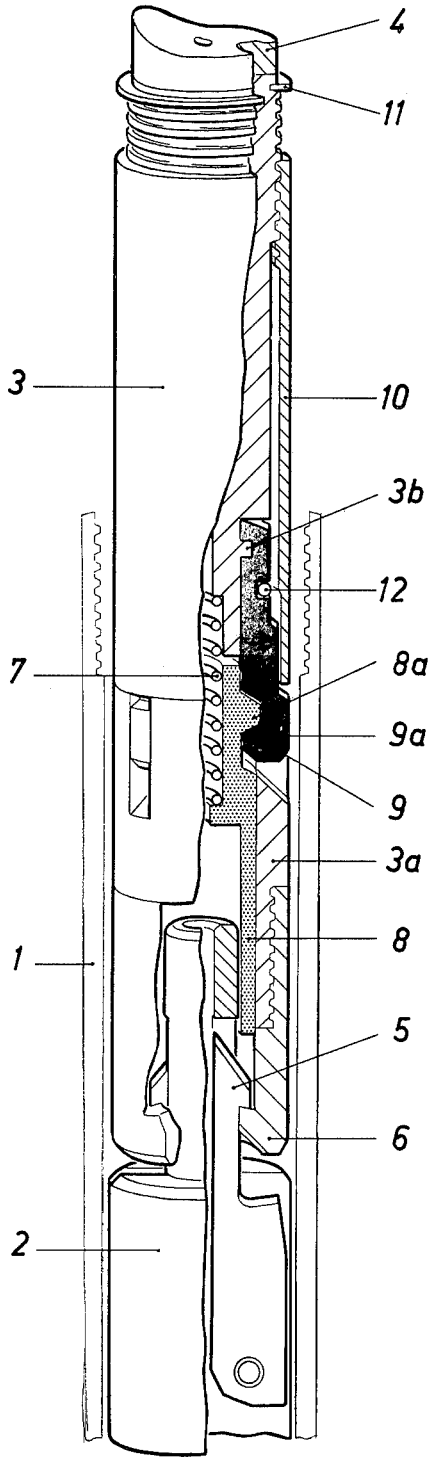
FIG. 1 is a partially cut-away perspective view of the lower part of the grappling means including the device in accordance with the invention and an upper part of a core barrel connected to the grappling means, the barrel and a portion of the grappling means being inserted in the upper portion of the hollow top rod in a drill rod string.
Figure 2:
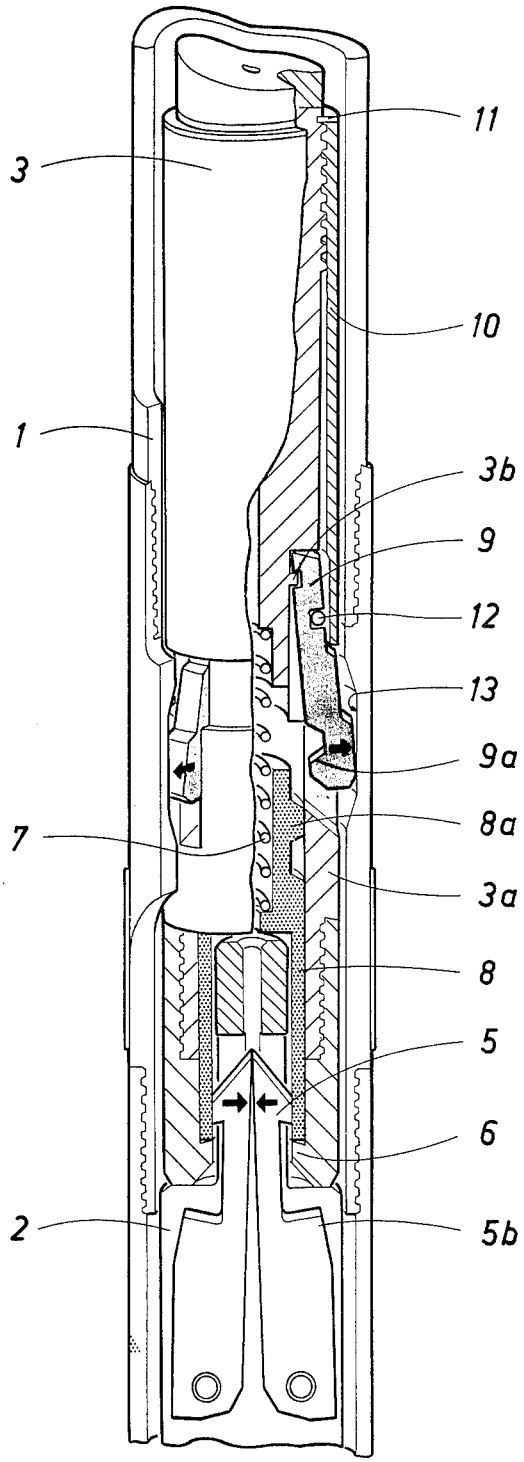
FIG. 2 is a view similar to the one in FIG. 1 and shows the core barrel in a working position in the bottom drill rod immediately after the inventive means has disengaged the coupling between grappling means and core barrel.
Figure 3:
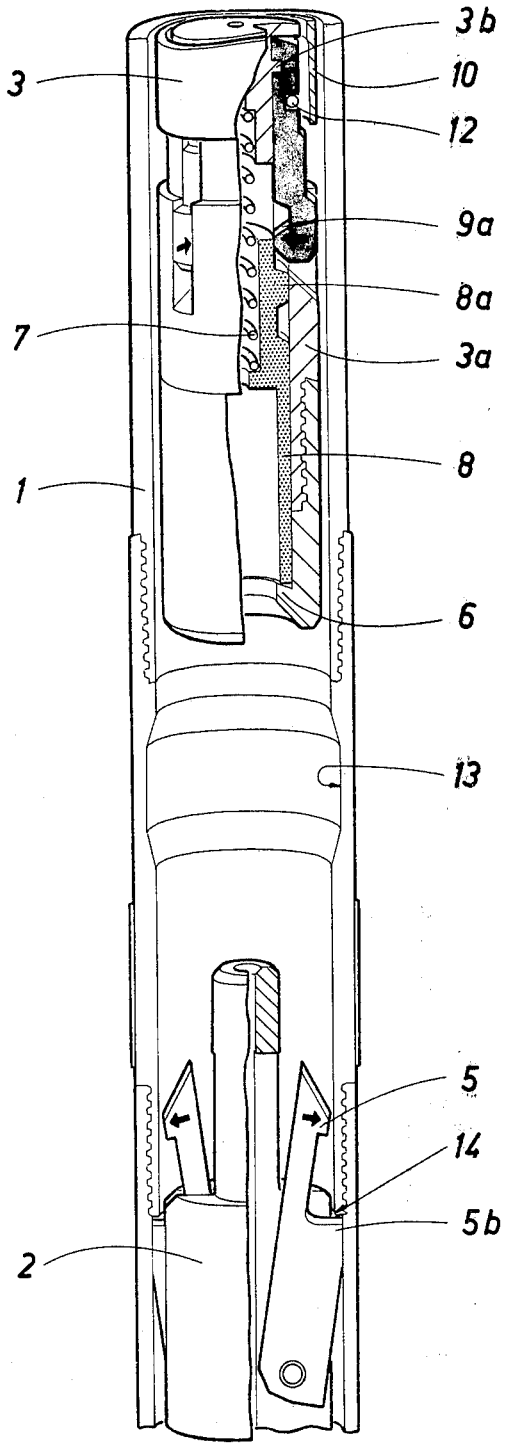
FIG. 3 is a view similar to the ones in FIGS. 1 and 2, and shows the core barrel in a working position with the grappling means disengaged from it and somewhat pulled up.

The upper portion of a rotatable drill rod string denoted by the numeral 1 is illustrated in FIG. 1. In FIGS. 1–3 there is illustrated the upper portion of a conventional core barrel 2, e.g. of the kind illustrated in U.S. Pat. No. 3,701,389, and intended for lowering in the string to assume a working position in the bottom section thereof, which is provided with a drill bit. A grappling means provided with a long wire or cable is used to lower the core barrel 2 to its working position, this wire also being used to pull up the barrel from the string when drilling is stopped. Only a lower portion of this grappling means, denoted by the numeral 3, is illustrated in FIGS. 1–3, this portion being removably connected by means of a screw thread to the remaining portion 4 of the grappling means, which is of a conventional configuration.

As will be seen from FIG. 1, the lower portion of the grappling means 3 is coupled to the upper portion of the core barrel 2 by means of spring-biased latching dogs 5, swivelably mounted on the core barrel, engaging with an inwardly directed flange 6 on the lower, sleeve-shaped portion 3*a* of the grappling means. This connection is made before the barrel is inserted in the string. Before connection, an axially movable disengaging sleeve 8 concentric to, and inside the portion 3*a*, has been displaced upwards against the bias of a compression spring 7 to the position illustrated in FIG. 1, and an annular projection 8*a* on the sleeve 8 is caused to engage with a plurality of, and preferably three, latching dogs 9, of which one is shown in the Figures, the dogs being distributed around the periphery of the grappling means and pivotally mounted thereon. The dogs 9, the upper ends of which are mounted in the grappling means and kept in place by the projection 3*b* and an elastic O-ring 12, are kept in engagement with the projection 8*a*, thereby retaining the sleeve 8 by the lower portion of a sleeve 10 threaded onto the cylindrical surface of the grappling means being taken into a lower position to urge the dogs 9 radially inward.

When the core barrel 2 with the grappling means 3 connected to it has been lowered down the top rod 1 to the position illustrated in FIG. 1 the sleeve 10 is turned manually so that it is displaced upwards on the grappling means from the position shown in FIG. 1 to an upper position, in which the upper edge of the sleeve engages against an abutment 11 on the grappling means. The lower portion of the sleeve 10 thus relinquishes engagement with the latching dogs 9, the bottom portions of which are pressed outwards by the bottom surfaces of the projection 8*a* incorporated in the spring-biased sleeve 8 press against a sloping surface 9*a* in a recess in each dog 9. The outwardly directed movement of the dogs 9 continues until they engage against the inner surface of the rod 1, but is not sufficiently long for the dogs to relinquish their grip on the projection 8*a* so that the sleeve 8 can move downwards.

The barrel 2 and grappling means 3 can now be lowered into the drill rod string 1. During this procedure the dogs 9 glide along and press against the bore of the string and can therefore not release the disengagement sleeve 8, not even if the grappling means 3 assumes a decentralised position in the string, since at least one of the three dogs always retains its grip on the projection 8*a*. First when the barrel 2 is in, or is immediately above, its working position in the lower portion of the string can the dogs 9 leave their retaining position around the sleeve 8, and be moved into an annular recess 13 in the bore of the bottom drill rod. The outwardly directed movement of the dogs 9 is achieved by the pressure of the projection 8*a* against the surfaces 9*a* provided by the spring 7. When the projection 8*a* leaves the dogs 9, the sleeve 8 is displaced downwardly inside the grappling means 3 and is inserted between the gripping jaws 5 and portion 3*a* so that the jaws are displaced radially inwards against spring bias. Immediately after the sleeve 8 has left the dogs 9, these are displaced radially inwards by the action of the force in the elastic O ring 12. The downward movement of the sleeve 8 continues unitl its bottom edge rests against the upper side of the flange 6. This condition is illustrated in FIG. 2.

The grappling means 3 can now be pulled up with the aid of the wire attached to its upper portion, since the sleeve 8 has inhibited the coupling grip between the grappling means and the core barrel. During the first phase of withdrawal, the gripping jaws 5 glide against the inner surface of the sleeve 8 and cannot engage with the flange 6, since the inner diameter of the sleeve is somewhat less than the inner diameter of the flange.

In FIG. 3, the grappling means 3 is shown disengaged and in a position at a distance from the core barrel 2. The locking jaws 5 of the barrel are also shown in the figure, after they have left the grappling means and have swung radially outwards, and the latching means 5*b* thereon have been inserted under a shoulder 14 in the bottom drill rod to prevent the axial displacement of the barrel upwards from its working position during drilling.

Figure 4:
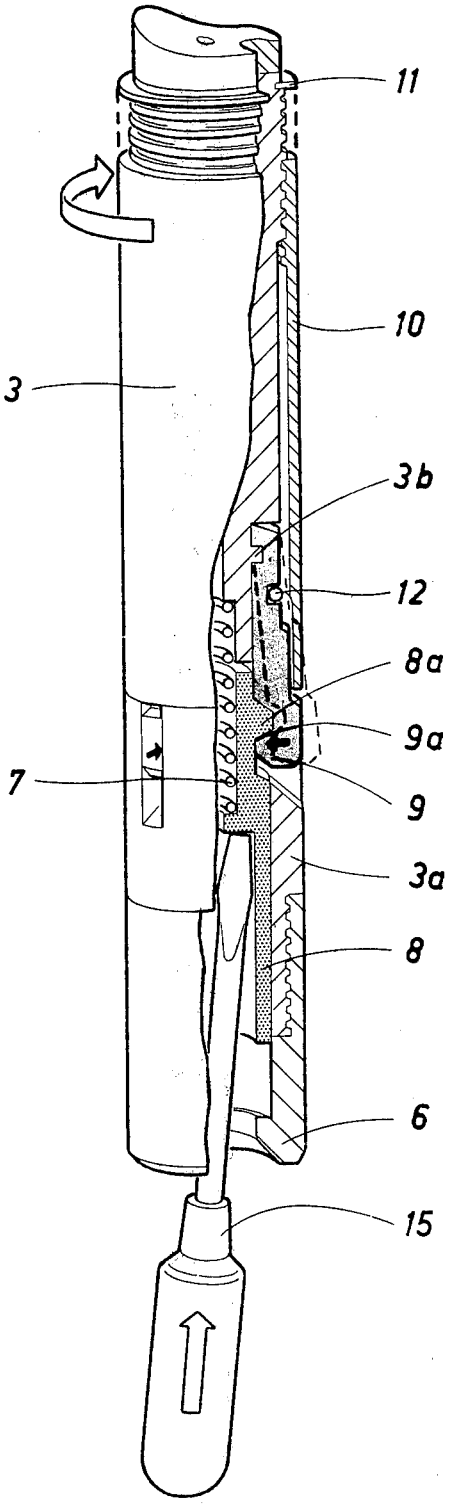
FIG. 4 is a side view, partially in section, of the lower portion of the grappling means according to FIGS. 1–3.

When the grappling means 3 has been taken up out of the string, the sleeve 8 is pressed upwards against the bias of the spring 7 by some suitable tool, e.g. a screwdriver 15, in the manner shown in FIG. 4, until the projection 8*a* is accommodated in the recesses of the dogs 9, the sleeve 10 then being screwed downwards onto the grappling means until the sleeve has assumed the position shown by full lines in FIG. 4, where it prevents the dogs 9 from swinging radially outwards. The screwdriver 15 can then be removed and the grappling means lowered into the string 1 for connection to the core barrel 2, when it is desired to pull up the latter from the string. As the grappling means is sunk in the string, the sleeve 10 assumes the attitude shown by full lines in FIG. 4, signifying that the sleeve 8 can never be displaced axially downwards relative to the rest of the grappling means, not even when the dogs 9 are opposite the recess 13. When the lower portion of the grappling means (the flange 6) strikes against the locking jaws 5 of the core barrel, the jaws are swung radially inwards from the position shown in FIG. 3 and taken into engagement with the flange 6 simultaneously as the latching portions 5*b* of said jaws are swung inwards and leave the shoulder 14. The grappling means is now connected to the barrel in the manner shown in FIG. 1 and can be pulled up from the drill rod string.

It will be understood that even if only one embodiment of the invention has been described above and illustrated on the drawings the invention is not limited to this embodiment, but solely by the disclosures in the claims.

We claim:

1. Device for disengaging a grappling means from a core barrel, the means and the barrel in a connected state being lowered into a hollow drill rod string, characterized in that the grappling means is adapted for actuation by at least one recess made in the drill rod bore when the core barrel is at a predetermined distance from, and assumes a working position in the bottom end of the drill rod string, thereby disengaging connecting means connecting the grappling means and the core barrel.

2. Device as claimed in claim 1, characterized in that the recess constitutes an annular groove in the drill rod bore.

3. A device as claimed in claim 1 or 2, characterized by latching dogs pivotably mounted on the grappling means, said dogs being adapted for swinging into said recess, thereby relinquishing engagement on a spring-biased disengaging means for movement towards, and release of said connecting means.

4. Device as claimed in claim 3, wherein said connecting means include locking jaws rotatably attached to the barrel and a sleeve attached to the grappling means, characterized in that the disengaging means formed as a sleeve is arranged concentrically inside the sleeve attached to the grappling means and is insertable between said locking jaws and coacting latching means on the sleeve attached to the grappling means to inhibit the connecting engagement between them.

5. Device as claimed in claim 4, characterized by a locking means for maintaining the latching engagement between the latching dogs and disengaging means before the grappling means and the core barrel connected thereto are inserted in the drill rod string.

6. Device as claimed in claim 5, characterized in that the locking means comprises a sleeve partially surrounding the grappling means and preferably screwed onto the cylindrical surface of the grappling means, said sleeve being axially displaceable relative to said grappling means for releasing the latching dogs after they have been lowered into the drill rod.

7. Device as claimed in claim 3, characterized by a locking means for maintaining the latching engagement between the latching dogs and disengaging means before the grappling means and the core barrel connected thereto are inserted in the drill rod string.

8. Device as claimed in claim 7, characterized in that the locking means comprises a sleeve partially surrounding the grappling means and preferably screwed onto the cylindrical surface of the grappling means, said sleeve being axially displaceable relative to said grappling means for releasing the latching dogs after they have been lowered into the drill rod.

* * * * *